US008902215B2

(12) United States Patent
Park et al.

(10) Patent No.: US 8,902,215 B2
(45) Date of Patent: Dec. 2, 2014

(54) METHOD AND MOBILE TERMINAL FOR ADJUSTING FOCUS OF A PROJECTED IMAGE

(75) Inventors: Byeong-Hoon Park, Gyeonggi-do (KR); Jung-Kee Lee, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 96 days.

(21) Appl. No.: 13/592,901

(22) Filed: Aug. 23, 2012

(65) Prior Publication Data

US 2013/0050178 A1 Feb. 28, 2013

(30) Foreign Application Priority Data

Aug. 23, 2011 (KR) ..... 10-2011-0084033

(51) Int. Cl.
*G09G 5/00* (2006.01)
*G09G 3/00* (2006.01)

(52) U.S. Cl.
CPC ..... *G09G 3/002* (2013.01); *G09G 2320/0693* (2013.01); *G09G 2354/00* (2013.01)
USPC ..... 345/214; 345/204

(58) Field of Classification Search
CPC .. G09G 3/22; G09G 3/001; G09G 2320/0693
USPC ..... 345/204–214, 690–699
See application file for complete search history.

(56) References Cited

U.S. PATENT DOCUMENTS 6,846,081 B2 * 1/2005 Mochizuki et al. ..... 353/70
7,798,656 B2 * 9/2010 Nozaki et al. ..... 353/100
8,123,363 B2 * 2/2012 Nozaki et al. ..... 353/69
8,175,639 B2 * 5/2012 Amirmokri ..... 455/556.1
8,421,867 B2 * 4/2013 Nozaki ..... 348/207.99
8,523,366 B2 * 9/2013 Takahashi ..... 353/69
2005/0253776 A1 * 11/2005 Lee et al. ..... 345/1.3
2006/0109426 A1 * 5/2006 Williams ..... 353/69
2006/0152682 A1 * 7/2006 Matsuda et al. ..... 353/40
2008/0024738 A1 * 1/2008 Nozaki et al. ..... 353/101
2008/0259289 A1 * 10/2008 Nozaki et al. ..... 353/70
2009/0016710 A1 * 1/2009 Nozaki et al. ..... 396/159
2009/0021946 A1 * 1/2009 Nozaki et al. ..... 362/296
2009/0027570 A1 * 1/2009 Fujinawa ..... 348/744
2009/0135258 A1 * 5/2009 Nozaki ..... 348/207.99
2009/0244048 A1 * 10/2009 Yamanaka ..... 345/212
2010/0026972 A1 * 2/2010 Kaneko ..... 353/101
2010/0165168 A1 * 7/2010 Takahashi ..... 348/333.1
2010/0177283 A1 * 7/2010 Tanaka ..... 353/69
2010/0185970 A1 * 7/2010 Benenson ..... 715/772
2010/0188643 A1 * 7/2010 Makino ..... 353/88

(Continued)

FOREIGN PATENT DOCUMENTS

KR 1020080044654 5/2008
KR 1020090111174 10/2009

*Primary Examiner* — Dmitriy Bolotin
(74) *Attorney, Agent, or Firm* — The Farrell Law Firm, P.C.

(57) ABSTRACT

A method and mobile terminal are provided for focus adjustment. The mobile terminal includes a projector module for projecting an image onto an external screen. The mobile terminal also includes a motion detection sensor for detecting motion of the mobile terminal. The mobile terminal further includes a controller for determining whether the motion detected by the motion detection sensor corresponds to activation of a focus adjustment mode of the mobile terminal, displaying a focus adjustment image, and performing focus adjustment of the projector module according to focus adjustment input provided in the focus adjustment mode.

13 Claims, 6 Drawing Sheets

(56) References Cited

U.S. PATENT DOCUMENTS

2010/0315602 A1* 12/2010 Takahashi ..... 353/70
2011/0032381 A1* 2/2011 Nara ..... 348/229.1
2011/0032492 A1* 2/2011 Nara ..... 353/70
2011/0075102 A1* 3/2011 Nozaki et al. ..... 353/30
2012/0106922 A1* 5/2012 Tsukagoshi ..... 386/230
2012/0113330 A1* 5/2012 Huang et al. ..... 348/744
2012/0313974 A1* 12/2012 Ueno et al. ..... 345/668

* cited by examiner

METHOD AND MOBILE TERMINAL FOR ADJUSTING FOCUS OF A PROJECTED IMAGE

PRIORITY

This application claims priority under 35 U.S.C. §119(a) to a Korean Patent Application filed in the Korean Intellectual Property Office on Aug. 23, 2011 and assigned Serial No. 10-2011-0084033, the entire disclosure of which is incorporated herein by reference.

BACKGROUND OF THE INVENTION

1. Field of the Invention

The present invention relates generally to a mobile terminal including a projector module, and more particularly, to an apparatus and method for adjusting focus with respect to an image projected in an enlarged manner from a mobile terminal having a projector module.

2. Description of the Related Art

Mobile terminals that include projector modules, multimedia projectors of an accessory type, removable projectors, and the like, have been developed. A micro-mini pico projector uses a Light Emitting Diode (LED), a laser, or the like, as a light source, and uses a Digital Mirror Device (DMD), a Liquid Crystal Display (LCD), a Liquid Crystal on Silicon (LCoS), or the like, as an image panel. These components allow for the manufacturing of a micro-mini and low-power module.

In a mobile terminal having a projector function, screen data of the mobile terminal is displayed outside the mobile terminal by using a wall or the floor as an external screen. A user can only view enlarged screen data when the screen data output from the mobile terminal onto the external screen is properly focused. In general, a mini projector such as an office data projector, a pocket imager, or the like, is installed at a fixed position, such that the focus is adjusted through a single initial setting operation. For example, for focus adjustment, a conventional projector is equipped with a manual focus wheel, which allows the user to turn a body tube of a projection lens by hand for adjustment. Therefore, the user adjusts focus while viewing the image projected on the external screen by using the focus wheel.

A mobile pico projector requires focus adjustment more frequently due to frequent movement. When a moving image is projected in an enlarged manner, effective focus adjustment is not often easy to achieve. For example, in the case of a moving image, the image continuously changes or an object for focus adjustment may not exist. As a result, the user may have difficulty in focusing while viewing the image. Moreover, when a mobile terminal is moved for focus adjustment, the moving image is reproduced with reflection of such movement therein, disturbing the reproduction of the moving image.

The mobile pico projector is equipped with a processor having a function of actively reproducing and processing data arbitrarily, moving anytime, and allowing convenient use in any position and situation.

SUMMARY OF THE INVENTION

The present invention has been made to address at least the above problems and/or disadvantages and to provide at least the advantages described below. Accordingly, an aspect of the present invention provides an apparatus and method for facilitating focus adjustment for an image in a mobile terminal, which has a projector function for projecting the image in an enlarged manner onto an external screen.

Another aspect of the present invention provides an apparatus and method for easily and efficiently controlling focus without physical contact with a mobile terminal having a projector function.

According to an aspect of the present invention, a mobile terminal is provided for focus adjustment. The mobile terminal includes a projector module for projecting an image onto an external screen. The mobile terminal also includes a motion detection sensor for detecting motion of the mobile terminal. The mobile terminal further includes a controller for controlling to display a focus adjustment image onto the external screen when the detected motion corresponds to activation of a focus adjustment mode of the mobile terminal, and performing focus adjustment of the projector module according to focus adjustment input provided in the focus adjustment mode.

According to another aspect of the present invention, a method is provided for focus adjustment in a mobile terminal having a projector module. An image is projected onto an external screen upon activation of the projector module. Motion of the mobile terminal is detected. It is determined whether the detected motion corresponds to activation of a focus adjustment mode of the mobile terminal. A focus adjustment image is displayed onto the external screen when it is determined that the detected motion corresponds to activation of the focus adjustment mode. Focus adjustment of the projector module is performed according to focus adjustment input provided in the focus adjustment mode.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF EMBODIMENTS OF THE PRESENT INVENTION

Figure 1:
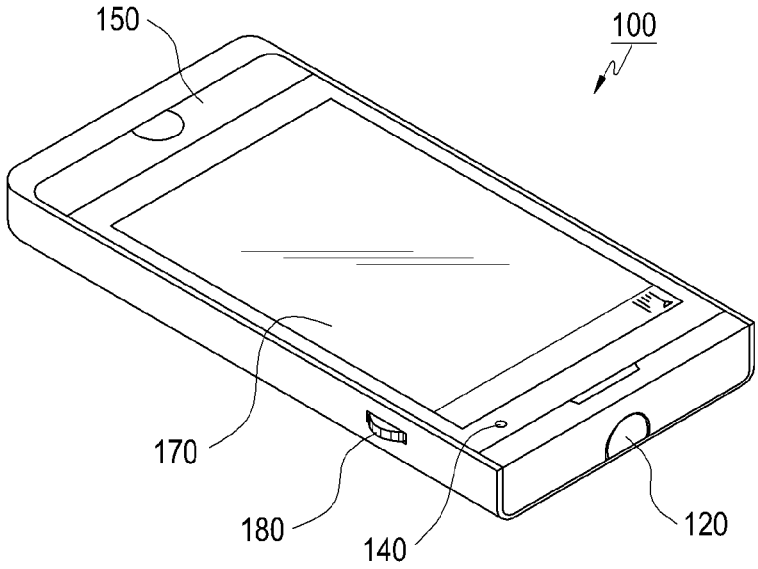
FIG. 1 is a diagram illustrating a perspective view of a mobile terminal including a projector module, according to an embodiment of the present invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Embodiments of the present invention provide a method for facilitating focus adjustment with respect to an image, which is projected in an enlarged manner from a mobile terminal having a projector function onto an external screen. Embodiments of the present invention determine whether a command for activation of a focus adjustment mode is input, output a focus adjustment image in an overlaid manner onto an image projected in an enlarged manner upon activation of the focus adjustment mode, and perform a focus adjustment function according to focus adjustment input. Thus, the focus adjustment function can be easily controlled, maximizing user convenience.

Referring initially to FIG. 1, a diagram illustrates a structure of a mobile terminal having a projector module with the foregoing function implemented therein, according to an embodiment of the present invention.

In FIG. 1, a mobile terminal 100 having a touch screen is shown. As shown in FIG. 1, the mobile terminal 100 includes a projector module 120, which enlarges an image and projects the enlarged image onto an external screen. The mobile terminal 100 also includes a camera unit 140, which captures the image projected in an enlarged manner to calculate the degree of focusing. The mobile terminal further includes an input unit 150, which receives an input signal from a user, and a display unit 170, which displays the image. Focus adjustment for the image projected in the enlarged manner may be performed through a user interface displayed on the display unit 170 of a touch screen type. The mobile terminal 100 may further include a focus wheel 180 for adjusting focus with respect to the projector module 120.

Figure 2:
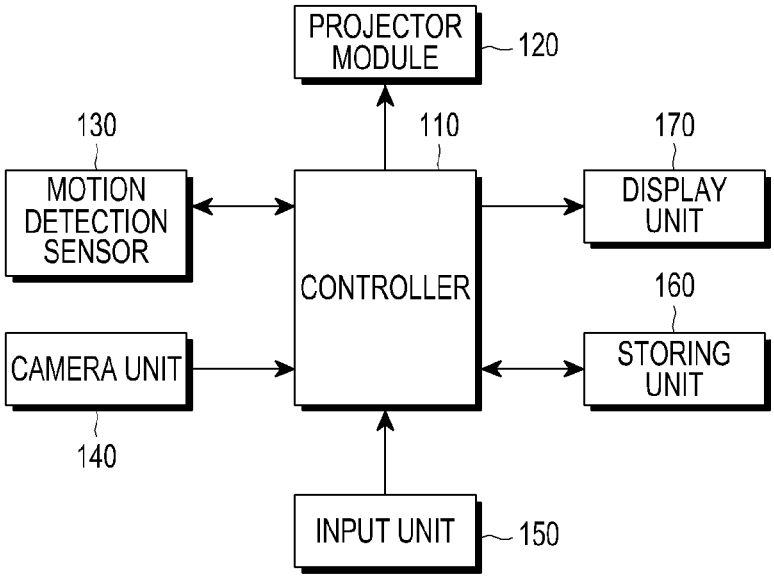
FIG. 2 is an internal block diagram of a mobile terminal, according to an embodiment of the present invention.

The internal structure of the mobile terminal 100 is illustrated with respect to FIG. 2. While certain blocks necessary for describing operations of the mobile terminal 100 are shown in FIGS. 1 and 2, the mobile terminal 100, according to embodiments of the present invention, is not necessarily limited to such a structure.

Referring to FIG. 2, the projector module 120 is embedded in the mobile terminal 100, and projects various images in an enlarged manner. The various images are provided from a controller 110 onto the external screen through a projection lens.

A motion detection sensor 130 may be embodied as an acceleration sensor, a geo-magnetic sensor, a gyro-sensor, or the like. The motion detection sensor is capable of detecting motion of the mobile terminal 100. The motion detection sensor 130 detects motion of the mobile terminal 100 for focus adjustment and provides the detected motion data to the controller 110.

The camera unit 140 captures an image to be projected onto the external screen. The captured image is used to calculate a focus adjustment value.

The input unit 150 delivers an input signal, which is associated with the setting and controlling of respective functions of the mobile terminal 100, to the controller 110. The input unit 150 may include input keys and function keys for generating the input signal, and may further include the focus wheel 180 for focus adjustment, as shown in FIG. 1. The input unit 150 may also include a projector function key for executing a projector function. The projector function key may be used for activation of the focus adjustment mode.

A storing unit 160 may be embodied as a Read Only Memory (ROM), a Random Access Memory (RAM), or the like. The storing unit 160 stores various data generated and used in the mobile terminal 100. The data may include data generated according to execution of an application of the mobile terminal 100 and data of any form that is generated by or received from a device external from the mobile terminal 100. The storing unit 160 may store data, such as, for example, items, moving images, and so forth, which are set for control of the projector function when the projector function is executed. The storing unit may also store setting information for focus adjustment according to the projector function. For example, the storing unit 160 stores setting information for focus adjustment, which corresponds to a detected motion.

The display unit 170 may be embodied as a Liquid Crystal Display (LCD) panel. When the LCD panel is implemented in the form of a touch screen, the display unit 170 operates as an input means. The display unit 170 displays information inputted by the user or information to be provided to the user, as well as various menus of the mobile terminal 100. More specifically, the display unit 170 displays a menu according to the operation of the projector module 120, and can display an image identical to that displayed through the projector module 120.

The controller 110 controls the general operation of the mobile terminal 100 and a signal flow between each of the elements of the mobile terminal 100. The controller 110 outputs a control signal so as to display the image in accordance with the standard of each of the display unit 170 and the projector module 120. In particular, the controller 110, according to an embodiment of the present invention, determines whether a focus adjustment command corresponding to the motion detected by the motion detection sensor 130 is input. If the focus adjustment command corresponding to the detected motion is input, the mode is changed to the focus adjustment mode.

Upon activation of the focus adjustment mode, the controller 110 processes output of focus adjustment screen data through the display unit 170 and output of an image projected in an enlarged manner and a focus adjustment image through the projector module 120. The controller 110, when using a Red/Green/Blue (RGB) interface scheme as an image output scheme, delivers an identical image to the display unit 170 and the projector module 120 such that the identical image is displayed through the display unit 170 and the projector module 120. However, when using a Central Processing Unit (CPU) interface or serial interface scheme, the controller 110 may deliver a differently processed image to the display unit 170, such that a different image than an image delivered to the projector module 120 can be displayed through the display unit 170. Change to the focus adjustment mode may also be made in response to pressing of the projector function key included in the input unit 150 as well as the motion detection scheme of the mobile terminal 100.

The controller 110, according to another embodiment of the present invention, measures an edge value of an image obtained by the camera unit 140 and calculates focus adjustment information based on the measured edge value. For example, the controller 110 calculates, as focus adjustment information, an amount by which focus has to be adjusted according to the measured edge value. The focus adjustment information is output on the focus adjustment image, allowing the user to perform an accurate focusing operation based on the focus adjustment information. Alternatively, the controller 110 may adjust the projection lens of the projector module 120 by using the focus adjustment information, allowing for automatic focusing without user manipulation.

Figure 3:
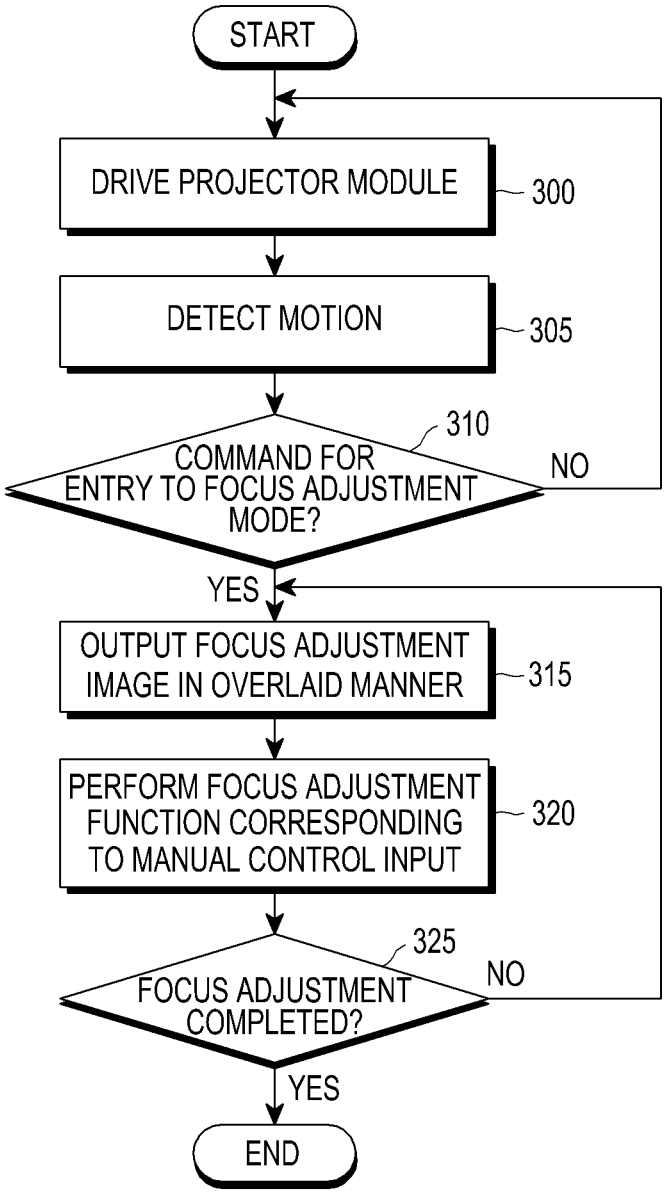
FIG. 3 is a flowchart illustrating operations in a mobile terminal for focus adjustment, according to an embodiment of the present invention.

Referring now to FIG. 3, a flow diagram illustrates an operating process for focus adjustment in a mobile terminal, according to an embodiment of the present invention. The description of FIG. 3 is made with reference to FIGS. 5A and 5B, however, the focus adjustment command corresponding to the detected motion is not limited to that provided in FIGS. 5A and 5B.

Referring to FIG. 3, the projector module 120 is driven, in step 300. The mobile terminal 100 projects an image in an enlarged manner onto an external screen through the projector module 120. In step 305, the mobile terminal 100 detects motion through the motion detection sensor 130. In step 310, the mobile terminal 100 determines whether the detected motion corresponds to a command for activation of the focus adjustment mode. If the detected motion does not correspond to the command for activation of the focus adjustment mode, the methodology returns to step 300. If the detected motion corresponds to the command for activation of the focus adjustment mode, the mobile terminal 100 outputs a focus adjustment image in an overlaid manner onto the projected image, in step 315.

Figure 5A:
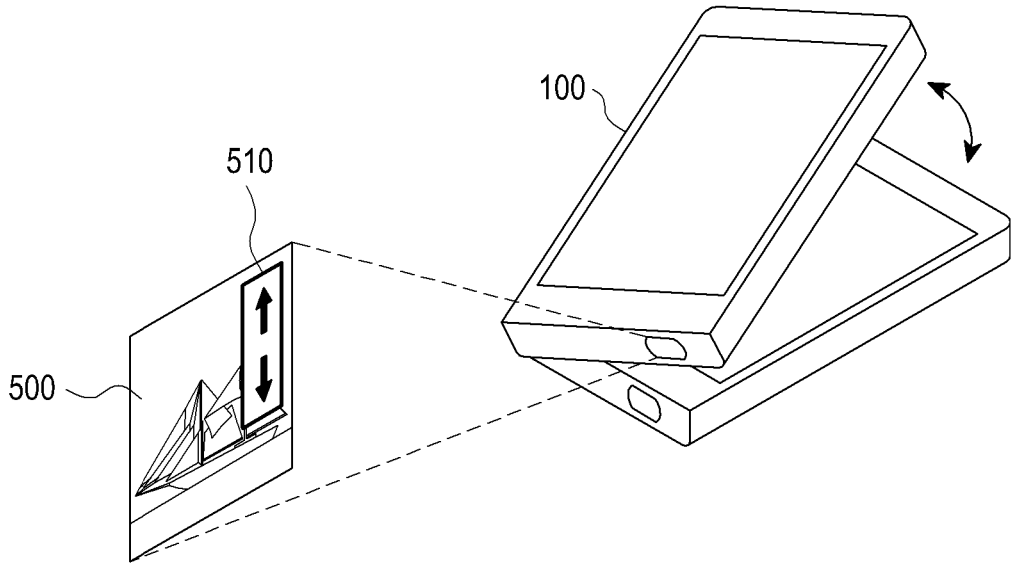
FIGS. 5A and 5B are diagrams illustrating motion of a mobile terminal for activation of a focus adjustment mode based on FIG. 3, according to an embodiment of the present invention.
Figure 5B:
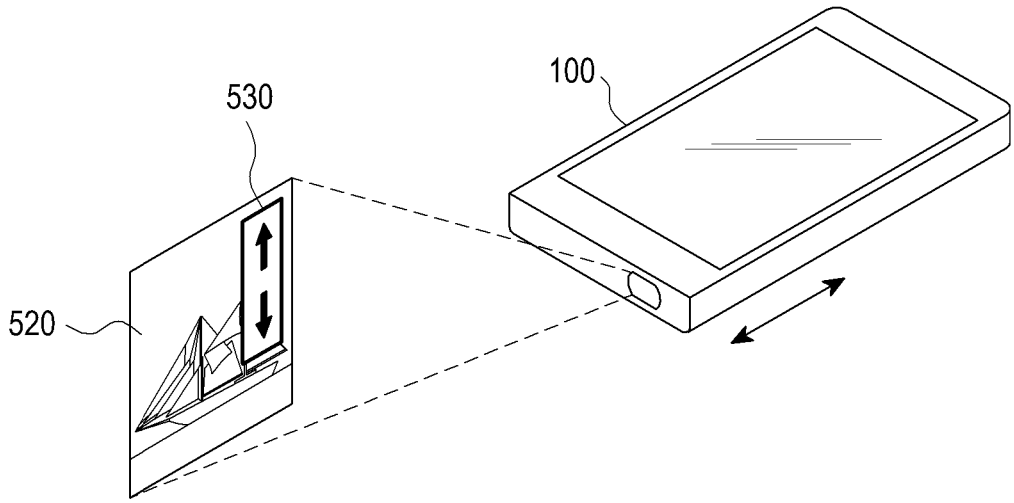

FIGS. 5A and 5B are diagrams illustrating motion of a mobile terminal for activation of a focus adjustment mode based on FIG. 3, according to an embodiment of the present invention. In FIG. 5A, it is determined that user's rotation of the mobile terminal 100 by a predetermined angle or more corresponds to the command for activation of the focus adjustment mode, such that a focus adjustment image 510 for focus adjustment is displayed in an overlaid manner on a projected image 500. In FIG. 5B, by moving the mobile terminal 100 back and forth in a lateral direction, a focus adjustment image 530 is displayed in an overlaid manner on a projected image 520. Thus, the motion detection scheme does not require a separate key for focus adjustment in the mobile terminal as it can be implemented with hardware.

Once the focus adjustment images 510 and 530 are displayed, the user adjusts focus by using a user interface for focus adjustment of the projector module 120, which is displayed on the display unit 170, or by using the focus wheel 180. The user interface for focus adjustment may be output in the form of a popup window on the image displayed on the display unit 170, or may be in the form of an icon that allows for forward/rewind control.

Referring back to FIG. 3, in response to manual control input from the user, the mobile terminal 100 performs a focus adjustment function, in step 320. In step 325, it is determined if focus adjustment is completed. When focus adjustment is not completed, the methodology returns to step 315 to allow for continued adjustment. When focus adjustment is completed, the methodology terminates. Thus, the user may perform a focusing operation by controlling the user interface or the focus wheel 180. The focus adjustment mode may be terminated when a predetermined amount of time expires in accordance with a timer. The focus adjustment mode may also be terminated based on the motion detection scheme through movement of the mobile terminal 100 in a manner similar to that described above. As a result, the focus adjustment image is no longer output to overlay the projected image.

Figure 7A:
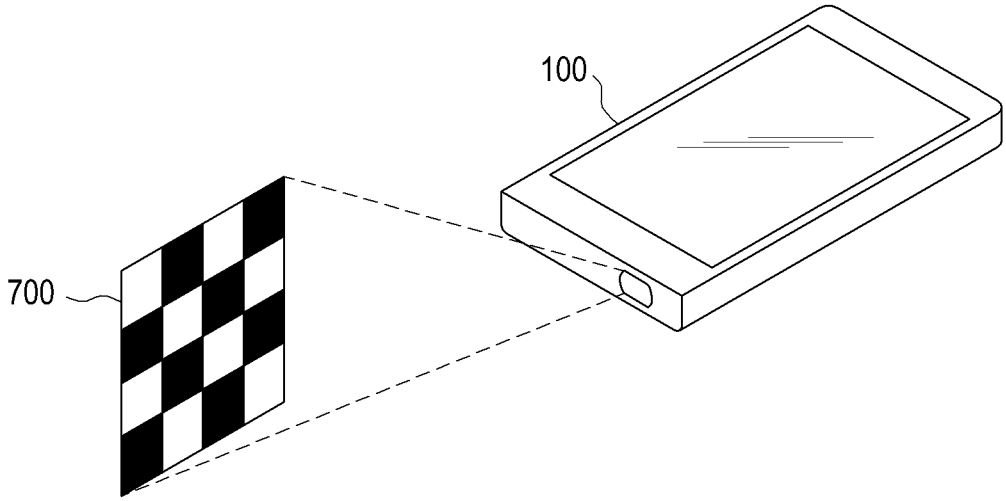
FIGS. 7A and 7B are diagrams illustrating a focus adjustment image, according to an embodiment of the present invention.
Figure 7B:
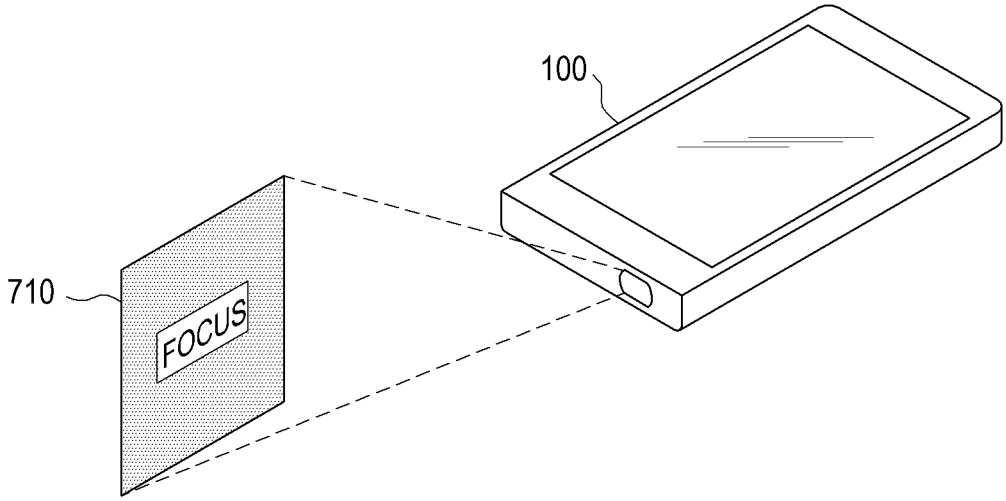

While the focus adjustment image is overlaid onto the projected image in the foregoing description, in an alternate embodiment of the present invention, the projected image may be replaced by the focus adjustment image. FIGS. 7A and 7B are diagrams illustrating a focus adjustment image, according to an embodiment of the present invention. For example, a predetermined checkerboard pattern 700 may be projected instead of the projected image in order to facilitate a determination of focusing accuracy, as shown in FIG. 7A. Further, a focus adjustment image 710 may be projected which includes at least one letter, as shown in FIG. 7B. In FIGS. 7A and 7B, the user may adjust focus in such a way that a boundary between black and white is clear between the squares or letters.

Figure 4:
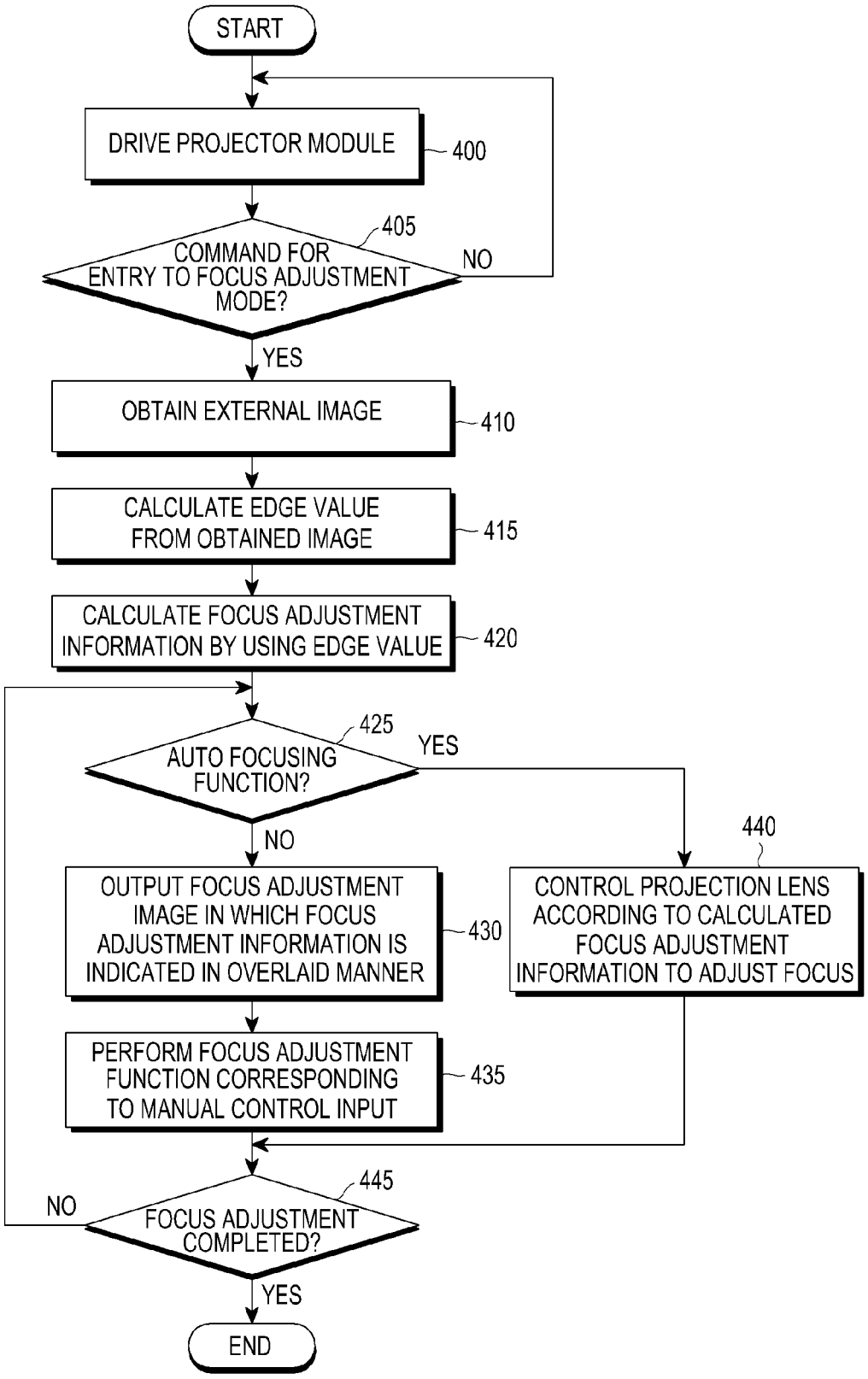
FIG. 4 is a flowchart illustrating operations in a mobile terminal for focus adjustment, according to another embodiment of the present invention.

FIG. 4 is a flow diagram illustrating an operating process for focus adjustment in a mobile terminal, according to another embodiment of the present invention. The description of FIG. 4 is made with reference to FIG. 6, however, a focus adjustment screen is not limited to that provided in FIG. 6.

Referring to FIG. 4, the projector module 120 is driven, in step 400, and the mobile terminal 100 projects an image in an enlarged manner onto an external screen through the projector module 120. In step 405, the mobile terminal 100 determines whether a command for activation of the focus adjustment mode is input. The command for activation of the focus adjustment mode may be input through a projector function key or the user interface displayed on the display unit 170. The command for activation of the focus adjustment mode may also be made through motion detection as described above with respect to FIG. 3. If the command for activation of the focus adjustment mode is not input, the methodology returns to step 400. If the command for activation of the focus adjustment mode is input, the mobile terminal 100 captures the projected external image through the camera unit 140, in step 410. More specifically, with respect to step 410, the camera unit 140 captures the output image in the same direction as the image output through the projector module 120.

The mobile terminal 100 calculates an edge value from the obtained image in step 415, and calculates focus adjustment information by using the edge value in step 420. The focus adjustment information may be calculated by analyzing the image captured by the camera unit 140, instead of using the edge value. The focus adjustment information intuitively indicates the accuracy of focusing, and may be expressed in the form of a number or an icon. In step 425, the mobile terminal 100 determines whether an auto focusing function is provided therein. If the auto focusing function is not provided in the mobile terminal 100, the mobile terminal 100 outputs the focus adjustment image on which the focus adjustment information is displayed in an overlaid manner on the projected image, in step 430.

Figure 6:
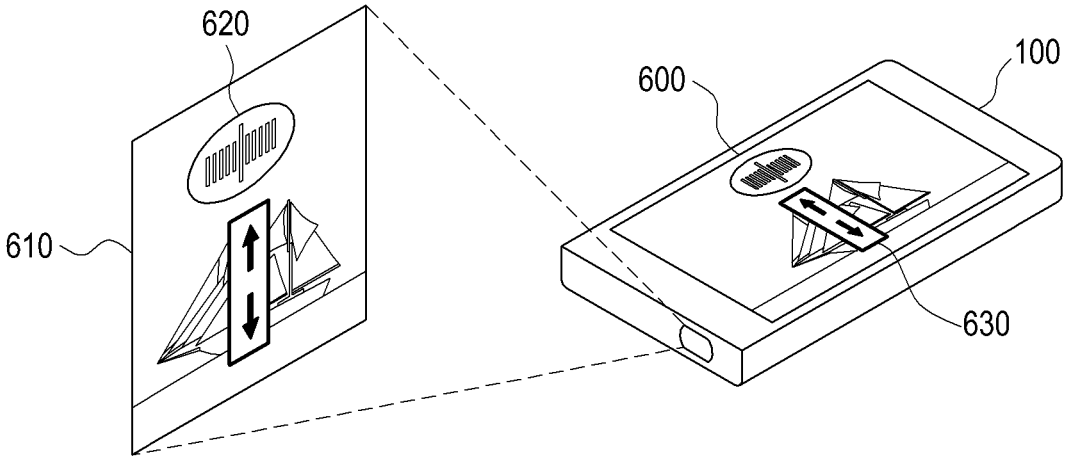
FIG. 6 is a diagram illustrating a focus adjustment image based on FIG. 4, according to an embodiment of the present invention.

FIG. 6 is a diagram illustrating a focus adjustment image based on FIG. 4, according to an embodiment of the present invention. In FIG. 6, focus adjustment information 620 is displayed in an overlaid manner on a projected image 610, and an image 600 displayed on the display unit 170 is the same as the projected image 610. The user may accurately adjust focus by using a user interface 630 that allows for forward/back input. The user interface 630 is displayed on the display unit 170 of the mobile terminal 100 with the focus adjustment information 620. As such, through output of the focus adjustment information, the user may intuitively adjust focus in an accurate manner.

Referring back to FIG. 4, the mobile terminal 100 performs a focus adjustment function corresponding to manual control input, in step 435.

If it is determined that the auto focusing function is provided in the mobile terminal 100 in step 425, the mobile terminal 100 controls a projection lens according to the focus adjustment information, thereby automatically adjusting focus, in step 440.

Upon completion of step 435 or step 440, the mobile terminal 100 determines whether focus adjustment is completed, in step 445. If focus adjustment is not completed, the methodology returns to step 425. If focus adjustment is completed, the methodology terminates.

As described above, according to embodiments of the present invention, a user can control a focus adjustment function through output of a focus adjustment image.

Moreover, even when focus adjustment is frequently required due to frequent movement of a mobile terminal having a projector function, a user can easily adjust focus. In addition, by informing a user of the amount of focus adjustment, the user can accurately adjust focus.

Furthermore, a motion detection module provided in the mobile terminal allows for easy control of the focus adjustment function, which maximizes user convenience. A motion user interface may also be applied to a projector to provide an intuitive user environment.

While the invention has been shown and described with reference to certain embodiments thereof, it will be understood by those skilled in the art that various changes in form and detail may be made therein without departing from the spirit and scope of the invention as defined by the appended claims and their equivalents.

What is claimed is:

1. A mobile terminal for focus adjustment, the mobile terminal comprising:

a projector module for projecting an image onto an external screen;

a motion detection sensor for detecting motion of the mobile terminal; and a controller for determining whether the detected motion corresponds to activation of a focus adjustment mode of the mobile terminal, calculating focus adjustment information when it is determined that the detected motion corresponds to activation of the focus adjustment mode, determining whether an auto focusing function is provided, if it is determined that an auto focusing function is not provided, outputting a focus adjustment image including the focus adjustment information onto the external screen, and performing focus adjustment of the projector module according to focus adjustment input based on the focus adjustment information provided in the focus adjustment mode, and if it is determined that an auto focusing function is provided, adjusting a projection lens of the projector module according to the focus adjustment information.

2. The mobile terminal of claim 1, wherein the focus adjustment image is overlaid on the projected image.

3. The mobile terminal of claim 1, further comprising a display unit for displaying a user interface for the focus adjustment input upon activation of the focus adjustment mode.

4. The mobile terminal of claim 1, further comprising a camera unit for capturing an image of the projected image.

5. The mobile terminal of claim 4, wherein the controller measures an edge value of the image captured by the camera unit, and calculates the focus adjustment information by using the measured edge value.

6. The mobile terminal of claim 1, further comprising a focus wheel for adjusting focus of the projector module according to the focus adjustment input.

7. The mobile terminal of claim 1, wherein upon activation of the focus adjustment mode, the controller stops outputting the projected image and outputs the focus adjustment image through the projector module.

8. The mobile terminal of claim 7, wherein the focus adjustment image comprises a black and white checker board pattern or an image having at least one letter.

9. A method for focus adjustment in a mobile terminal having a projector module, the method comprising the steps of:

projecting an image onto an external screen upon activation of the projector module;

detecting motion of the mobile terminal;

determining whether the detected motion corresponds to activation of a focus adjustment mode of the mobile terminal;

calculating focus adjustment information when it is determined that the detected motion corresponds to activation of the focus adjustment mode;

determining whether an auto focusing function is provided;

if it is determined that an auto focusing function is not provided, outputting a focus adjustment image including the focus adjustment information onto the external screen and performing focus adjustment of the projector module according to focus adjustment input based on the focus adjustment information provided in the focus adjustment mode; and if it is determined that an auto focusing function is provided, adjusting a projection lens of the projector module according to the focus adjustment information .

10. The method of claim 9, further comprising displaying a user interface for the focus adjustment input on a display unit of the mobile terminal upon activation of the focus adjustment mode.

11. The method of claim 9, further comprising:

capturing an image of the projected image;

measuring an edge value of the captured image; and calculating the focus adjustment information by using the measured edge value.

12. The method of claim 9, wherein displaying the focus adjustment image comprises:

stopping outputting the projected image and outputting the focus adjustment image through the projector module.

13. The method of claim 9, wherein displaying the focus adjustment image comprises:

overlaying the focus adjustment image onto the projected image.

* * * * *